United States Patent [19]
Flaterman et al.
[11] 3,968,723
[45] July 13, 1976

[54] METHOD FOR RECLAIMING AND RECYCLING PLASTIC BONDED ENERGETIC MATERIAL

[75] Inventors: Charles W. Falterman, China Lake; Fred Menz, Ridgecrest; Wallace E. Silver, Ridgecrest; Pearsie S. Wiggins, Ridgecrest, all of Calif.

[73] Assignee: The United States of America as represented by the Secretary of the Navy, Washington, D.C.

[22] Filed: Mar. 3, 1975

[21] Appl. No.: 554,358

[52] U.S. Cl. ..... 86/1 A; 102/23; 102/1 R; 149/92; 149/109.6
[51] Int. Cl.[2] ..... F42B 33/06; C06B 25/34
[58] Field of Search ..... 149/105, 92, 109.6; 102/23, 27 R, 1; 264/3 R; 86/1 A

[56] References Cited

UNITED STATES PATENTS

| | | | |
|---|---|---|---|
| 1,492,925 | 5/1924 | Knight | 86/1 A |
| 1,927,059 | 9/1933 | Bahlke | 196/69 |
| 3,063,373 | 11/1962 | Boddorff et al. | 102/23 |
| 3,296,041 | 1/1967 | Wright | 149/105 X |
| 3,407,731 | 10/1968 | Evans | 102/27 R |
| 3,610,150 | 10/1971 | Teichmann | 102/23 |
| 3,621,558 | 11/1971 | Welsh et al. | 102/27 R |
| 3,723,204 | 3/1973 | Evans | 149/92 X |
| 3,778,320 | 12/1973 | Yosim et al. | 149/92 X |
| 3,897,283 | 7/1975 | Wiebke et al. | 149/105 X |

*Primary Examiner*—Edward A. Miller
*Attorney, Agent, or Firm*—R. S. Sciascia; Roy Miller; Gerald F. Baker

[57] ABSTRACT

The plastic bonded explosive in obsolete or otherwise rejected warheads is explosively shocked out of the warheads so that materials from which the explosive is made can be recycled. The process involves placing detonating cord in a cavity left by the removal of the warhead's safe and arm mechanism and/or communications hole, pouring water into the cavity around the detonating cord and detonating the detonating cord.

9 Claims, No Drawings

METHOD FOR RECLAIMING AND RECYCLING PLASTIC BONDED ENERGETIC MATERIAL

BACKGROUND OF THE INVENTION

1. Field of the Invention

This invention relates to a method for recovering plastic bonded explosive material, for example, from obsolete or rejected warheads.

2. Description of the Prior Art

Military warheads are continually being replaced by newer and hopefully, better models. When this happens, the replaced warheads are said to be obsolete. Also, warheads sometimes become unsuitable for use because the plastic bonded explosive charges within them develop cracks or other flaws. In the past, it has been common practice to simply detonate or deep water dump obsolete or otherwise rejected warheads. However, with the advent of the recent national and international efforts to cut down on pollution of all types, it has become desirable to recycle the materials from which the plastic bonded explosives are fabricated.

The removal of plastic bonded explosives from obsolete or otherwise rejected warheads for recycling has presented problems. Cast or pressed explosive structures are not readily susceptible to chemical solvent breakdown or the like. That is, if one contacts a solid plastic bonded explosive structure which is still in a warhead with a chemical solvent to dissolve the plastic, the time required to dissolve the plastic is prohibitive-running into weeks or even months. Further, in some cases, cast or pressed plastic bonded explosive structures are not readily susceptible to machining or other techniques commonly used to remove one solid body from another.

SUMMARY OF THE INVENTION

It has now been found that a solid, plastic bonded explosive charge can be safely removed from a warhead by: (1) inserting detonating cord into the cavity left when the warhead's safe and arm mechanism is removed or into another suitable cavity, (2) substantially filling the rest of the cavity with water or another suitable fluid and (3) detonating the detonating cord. This process breaks the explosive charge into small pieces which can then be treated with solvents and other chemical reagents to dissolve the plastic leaving the explosive filler for reuse or which, in some cases, may be immediately reused with further treatment.

DESCRIPTION OF THE PREFERRED EMBODIMENT

Primacord, which may be used in the process of this invention, is a detonating cord consisting of a high explosive core, usually PETN (pentaerythritol tetranitrate), contained within a waterproof covering. It is a readily available commodity. RDX is sometimes used in the core in lieu of PETN. Ordinarily, Primacord contains coreloads of from 40 to 60 grains of explosive per foot. Typically, the detonation velocity of Primacord is about 7500 meters/sec. While the term "primacord" is used in describing the preferred embodiment, it will be recognized that other detonating cords with similar properties could be used.

A solid cast or pressed plastic bonded explosive charge in a warhead always has a safe and arm mechanism inserted within it when the warhead is ready for military engagement. When the safe and arm mechanism is removed, the explosive charge is left with a cavity in it. Some explosive charges have other cavities in them. In the practice of this invention, a suitable amount of Primacord or other suitable detonating cord is inserted into a suitable cavity in the explosive charge of the warhead and exploded. To enhance the results produced as the shock wave from the Primacord travels through the plastic bonded explosive, the Primacord is surrounded by water at the time of detonation.

The following specific examples disclose, in detail, how the explosive removal of plastic bonded explosives from warheads was carried out in the experimental development of this invention:

EXAMPLE 1

A MK 38 Mod 0 warhead containing 20.1 pounds of a pressed DATB-(diaminotrinitro benzene) nylon explosive composition was obtained and the aft plate and safe and arm mechanism were removed. Five 15-inch-long strands of 50-60 grain/ft. Primacord with four extra (4-inch) strands interwoven into the center of the original five were placed in the cavity provided by removal of the safe and arm mechanism. Water was then introduced into the warhead to surround the Primacord. The total explosive weight in the Primacord was about 33 grams. The Primacord was detonated from the aft end. All of the explosive composition was explosively shocked out of the warhead. The skin of the warhead was split open.

About 60% of the plastic bonded explosive was blown out of the aft end of the warhead and was captured in a container which had been placed on its side adjacent to the aft end for that purpose. About 30% of the explosive composition was blown out of the fore end of the warhead and captured in a similar container placed adjacent to the fore end.

About 50% of the recovered material was broken up into granules which resembled the original molding power. This 50% could be used, as recovered, to form another pressed explosive structure. The remaining 50% of the material had been broken up into larger pieces (up to about 3 inches in largest diameter). These pieces broke down into molding-powder-size granules after being soaked in water or another wetting agent for about 5 to 30 minutes.

EXAMPLE 2

In a series of tests, 1, 2, 3, 4 and 5 fifteen-inch-long strands of Primacord were utilized in lieu of the 5 fifteen-inch-long cords plus 4 four-inch ones of Example 1. In some cases the aft plate of the warhead was removed. In some it was not. In every case a large percentage of the pressed explosive was reduced to molding powder size which could simply by reused immediately and the remainder was broken up into pieces which could easily be treated with water or other wetting agents to obtain molding powder size granules.

In addition to pressed DATB-nylon explosives, the method of this invention can be used to remove other pressed explosive compositions and also cast and extruded explosive compositions from warheads. For example, pressed explosives containing HMX or RDX with a binder selected from the group consisting of nylon or Viton A may be removed. Also, cast and extruded explosive compositions containing HMX or RDX as the explosive filler and Laminacs, VITON A or other compositions as binders can be removed in a like manner. Removable explosive compositions may also contain aluminum particles and the like and other materials such as Teflon.

When a cast or extruded explosive is removed, one must naturally break down the binder by chemical means and separate it from the explosive filler before the materials can be reused. However, the particle size of the material removed is such that chemical treatment can easily and quickly be carried out whereas, when one must contact the solid explosive within the warhead with solvents to dissolve the binder, great amounts of time are required.

It will be realized that, once a cast explosive is explosively shocked out of a warhead and chemically treated to dissolve the binder, the recovered explosive filler can be used in any new explosive composition, i.e., it does not have to be used with the same binder. The dissolved binder may either be discarded or extracted from the solvent and reused.

It will be realized that different explosive compositions have different shock sensitivities. That is, some are more easily detonated than others. Accordingly, some care should be taken in selecting the amount of detonating cord used. That is, one would not use large amounts of detonating cord with highly sensitive explosive compositions.

What is claimed is:

1. A method for removing solid plastic-bonded high explosive material from a warhead casing without detonating said high explosive material comprising the steps of:

A. inserting, into a cavity in said solid plastic bonded high explosive material, a suitable length of detonating cord to partially fill the cavity;

B. substantially filling the remainder of the cavity with a suitable fluid; and

C. detonating the detonating cord.

2. A method according to claim 1 wherein said plastic bonded explosive is fabricated from diaminotrinitro benzene and nylon.

3. A process for the removal and salvage of solid plastic bonded high explosive material from warhead casings without exploding said high explosive materials including the steps of:

removing sufficient material from said solid explosive to form a cavity therein;

inserting one or more lengths of detonating cord in said cavity to partially fill the cavity; introducing a liquid into said cavity to substantially fill the remaining space in said cavity; and firing said detonating cord.

4. The method of claim 3 wherein said cavity is formed by removing warhead components from a central cavity.

5. The method of claim 4 wherein said detonating cord consists essentially of about 33 grams of 50–60 grain/foot and having a detonation velocity of about 75 hundred meters/second.

6. The method of claim 3 wherein said detonating cord consists essentially of about 33 grams of 50–60 grain/foot and having a detonation velocity of about 75 hundred meters/second.

7. The process of claim 3 wherein said fluid is water.

8. The process of claim 3 and further treating the recovered solid plastic explosive material to further reduce the particle size.

9. The process of claim 8 wherein said treatment includes soaking the pieces of explosive material in a suitable wetting agent.

* * * * *